United States Patent [19]

McNair et al.

[11] Patent Number: 4,888,494

[45] Date of Patent: Dec. 19, 1989

[54] ELECTROMECHANICAL LAMP SWITCHING

[76] Inventors: Rhett McNair, 1200 N. Van Buren, Anaheim, Calif. 92807; Martin E. G. Willcocks, 6321 W. 78th Pl., Los Angeles, Calif. 90045

[21] Appl. No.: 115,912

[22] Filed: Nov. 2, 1987

[51] Int. Cl.[4] ..... H05B 37/00

[52] U.S. Cl. ..... 307/38; 307/112; 307/132 M; 307/11; 315/185 S

[58] Field of Search ..... 307/34, 14 41, 64, 134, 307/130, 131, 132 R, 132 E, 132 EA, 132 V, 115, 112, 117, 141.8, 141.4, 141, 136; 315/149–159, 170, 172, 178, 112, 118, 117, 185 R, 185 S, 192, 193, 291, 209, 200 A, 201, 218, 313, 320; 340/648; 200/37 A, 38 R, 38 B, 38 BA, 38 C, 38 D, 39 R, 40, 61.02, 153 LB; 361/160, 166, 167, 168.1, 171, 183, 189, 190, 191, 195, 202, 206, 103–105, 110–113

[56] References Cited

U.S. PATENT DOCUMENTS

| | | | |
|---|---|---|---|
| Re. 31,667 | 9/1984 | Knauff | 340/648 X |
| 2,514,836 | 7/1950 | Buntzman | 307/132 M X |
| 3,002,112 | 9/1961 | Rubin | 361/8 |
| 3,221,174 | 11/1965 | Jacobs | 307/41 |
| 3,599,048 | 8/1971 | Olin | 307/117 X |
| 3,748,488 | 7/1973 | Davis, Jr. | 340/331 X |
| 3,808,450 | 4/1974 | Davis, Jr. | 307/38 |
| 3,812,380 | 5/1974 | Davis, Jr. | 307/11 |
| 3,862,434 | 1/1975 | Davis, Jr. | 307/132 |
| 3,864,580 | 2/1975 | Davis, Jr. | 315/185 S X |
| 3,946,244 | 3/1976 | Davis, Jr. | 315/185 S X |
| 3,969,736 | 7/1976 | Lehmann | 307/38 X |
| 4,001,810 | 1/1977 | Olsen | 340/331 X |
| 4,057,735 | 11/1977 | Davis, Jr. | 307/11 |
| 4,125,781 | 11/1978 | Davis, Jr. | 307/11 |
| 4,260,939 | 4/1981 | Knauff | 340/648 X |
| 4,447,846 | 5/1984 | McCleery | 361/104 X |
| 4,571,656 | 2/1986 | Ruckman | 361/111 X |
| 4,581,674 | 4/1986 | Brzozowski | 361/103 X |
| 4,584,622 | 4/1986 | Crosby et al. | 361/111 X |
| 4,587,588 | 5/1986 | Goldstein | 361/104 X |
| 4,616,286 | 10/1986 | Breece | 361/111 X |
| 4,678,926 | 7/1987 | Davis | 307/38 X |
| 4,740,861 | 4/1988 | Droho et al. | 361/103 X |
| 4,792,702 | 12/1988 | Masaki | 307/112 |

*Primary Examiner*—William M. Shoop, Jr.
*Assistant Examiner*—Paul Ip
*Attorney, Agent, or Firm*—James Creighton Wray

[57] ABSTRACT

An electromechanical switching device connects and disconnects a second lamp means from a first circuit powering a first lamp means upon alternate powerings of the first circuit. A mechanical device switches the switching means and an electrical circuit across the first circuit has a relay to control the mechanical device.

24 Claims, 4 Drawing Sheets

ELECTROMECHANICAL LAMP SWITCHING

SUMMARY OF THE INVENTION

The present invention provides a two-way switch device for automatic alternate switching of either one or two lamps in a common housing. The switching is effected whenever power is applied to the circuit. The invention provides a preferred approach and several alternative approaches to perform this function and to do so as reliably as possible.

The present invention provides the following advantages:

(1) Every time power is applied, the switching device operates and switches on either one or both lamps accordingly.

(2) The unit is ready to operate again within 200 to 600 milliseconds after power is switched off.

(3) A user-operable switch may be provided to permit individual units to be brought into step with other units.

(4) An object of the invention is to provide for minimum component count, size and cost.

(5) A further object of the invention is to permit operation at elevated temperatures, since the temperature inside the lamp housing may reach 105 degrees C.

In one embodiment, the present invention comprises two subassemblies; a switch subassembly having a microswitch operated by a cam which is integral with a pawl driven by a solenoid, and a small electronic circuit on a printed circuit board, typically potted in epoxy resin, which controls the switch subassembly.

Mechanical tests show that the maximum force needed to operate the pawl in this switch subassembly is seven to eight ounces. The solenoid has a 500 V coil-to-chassis withstanding voltage rating and can be used for class A (105 degrees C.) or class B (130 degrees C.) operating temperatures.

During testing of various electronic circuits to drive the solenoid it was determined that the pawl could be tripped to an unwanted stable intermediate position, with the ratchet loading spring wire pressing on the side of a pawl tooth instead of assisting the pawl to complete its rotation to the next position. The force required to operate the switch is dependent on the pressure applied by the spring, and can vary over a wide range, with correspondingly large variations in the pulse energy needed to operate the switch reliably. An open-ended drive circuit requires careful attention to the tensioning of the pawl holding spring in production units. The spring must be sufficiently soft to permit pawl movement with the power provided by the solenoid.

Two main classes of circuit for driving the solenoid are open-ended and closed loop circuits. A circuit is open-ended if it does not check to see if the desired operation has occurred before shutting off the solenoid power. A closed loop circuit verifies that the desired switching operation has been completed and then removes the power from the solenoid.

It is desirable to energize the solenoid for as short a period as possible, to minimize heating and power consumption. Several means may be used for energizing the solenoid only for a short period. The time delay required must either be sufficiently long to guarantee that the solenoid will always operate, or must be terminated by completion of switch operation.

Several technologies are proposed to achieve a delay. An electrical delay uses either inductive or capacitive energy storage. An optoelectronic delay uses a delay in reaching a given illumination level and/or photoelectric sensor response time. A thermal delay uses heating of an element to achieve a delay. A mechanical delay, as in the closed-loop embodiments, uses the time delay inherent in the solenoid operation. Combinations of these and other delays may be employed if they are capable of performing the desired delay function of holding the solenoid energized for a time sufficient to fully operate the pawl. When the switching delay is implemented in closed loop form, it guarantees that the function is performed every time.

The preferred apparatus for selectively illuminating first lamp means or both first and second lamp means comprises a first circuit having terminals for connecting to a supply line from a wall switch and being directly connected to the first lamp means for illuminating the first lamp means every time the wall switch supplies power to the terminals, a second circuit comprising switching means connected in series with the second lamp means being connected in parallel with the first lamp means for alternately connecting and disconnecting the second lamp means from the terminals supplying power to the first lamp means, and a control means comprising a control circuit and electromechanical operating means connected electrically thereto and connected mechanically to said switching means, said control means also being connected in parallel with the first lamp means.

Said electromechanical operating means is caused to operate by said control means every time the wall switch applies power to the terminals, and through said mechanical connection to said switching means causes the switching means to alternate between on and off conditions upon each operation of said operating means.

Said control means may be embodied in several different ways, incorporating means for energizing said operating means for a short period upon application or removal of power, which period may be determined by a predetermined delay time or by sensing that the operation has been completed.

In preferred embodiments of the first type, the delay time may be achieved through physical means such as the inherent response delay of a photoconductive cell, the thermal response time of a thermistor heated by an electrical current, or the charging time of a capacitor in series with a resistor. In preferred embodiments of the second type, the operation of the switching means causes the removal of power from the operating means immediately thereafter, and subsequently on removal of power from the control circuit the connection to the operating means is reinstated in preparation for the next application of power.

PREFERRED EMBODIMENTS OF THE INVENTION

In one preferred embodiment said control means comprises a series combination of a diode with a resistor and a capacitor connected in parallel and the coil of a solenoid comprising said electromechanical operating means. Power is provided from said first circuit terminals when the wall switch is turned on, rapidly charging the capacitor through the diode and the solenoid coil. The inrush current charging the capacitor is sufficient to operate the solenoid, causing the switch means mechanically connected thereto to change its condition. When the capacitor is fully charged, the current through the capacitor falls to zero and the current through the resistor is insufficient to sustain the solenoid's operation, causing the solenoid to drop out. After power is removed by the wall switch, said resistor discharges the capacitor relatively slowly but in a sufficiently short period that it can again operate the solenoid upon the next application of power by the wall switch.

In a second preferred embodiment, the control means comprises a resistor in series with a first solenoid coil and a second solenoid coil connected to the junction between said resistor and said first solenoid coil. Each of said solenoids further comprises mechanical operating means and a single-pole double-throw switching means. Said second solenoid coil is further connected to the pole of the switching means operated by said first solenoid, and the live terminal of the first circuit is connected to the pole of the switching means operated by said second solenoid, which serves to connect and disconnect the second lamp means from the live terminal of the first circuit. The first and second output terminals of said first switching means are connected to the corresponding terminals of the said second switching means. Said first solenoid is mechanically connected to operating means which is configured to operate the first switching means whenever power is removed from its coil after previously being applied.

During the period when no power is applied to the terminals by the wall switch, an electrical connection exists from the live terminal through the two switching means to the second solenoid, thence through the first solenoid to the neutral terminal. When power is applied, both solenoids receive sufficient current to pull in, said second solenoid thereby operating said second switch means to change its condition and thereby to switch said second lamp means on or off. In addition, this operation breaks the circuit to the operating coil of said second solenoid, causing it to drop out immediately this action is completed. Said first solenoid is maintained in the pulled-in condition through the resistor, which supplies only the holding current necessary. When power is removed, the first solenoid drops out, operating said first switching means and thereby re-establishing an electrical circuit through the two switches to the second solenoid. As power is no longer present, the second solenoid is not operated until the next application of power, when the cycle of operations is repeated.

In a third preferred embodiment the control means comprises the parallel combination of a first branch comprising a resistor in series with a control lamp, a second branch comprising a series resistor connected to a parallel combination of a capacitor with a resistor in series with a photoconductive cell, and a third branch comprising the coil of said electromechanical operating means in series with a triac whose gate electrode is connected through a diac to the junction of the series resistor and capacitor of said second branch, this entire circuit being connected in parallel with the first lamp means.

When power is first applied to said circuit, said control lamp is off, and said photoconductive cell has a high resistance, and the alternating voltage developed across the capacitor is sufficient to break down the diac and trigger the triac, thereby actuating the solenoid, which causes the said switching means to change its condition. Shortly after the application of power, the control lamp is illuminated and the resistance of the photoconductive cell falls to a value which no longer permits sufficient voltage to be developed across the capacitor to trigger the triac, which reverts to a high impedance state and de-energizes the solenoid coil.

When power is removed, the photoconductive cell resumes a high resistance state after a short time, ready for the next application of power. The time during which the operating means is operated depends upon the dark-to-light response time of the photoresistive cell. This embodiment has been described in copending application Ser. No. 774,552 entitled "Power Control Method and Apparatus."

In another preferred embodiment, the control means comprises the parallel combination of a first branch comprising a series resistor and a capacitor connected in parallel with a negative temperature-coefficient thermistor, and the operating coil of said operating means in series with a triac, whose gate terminal is connected through a diac to the junction of said series resistor and capacitor in the first branch, the complete circuit being connected in parallel with the first lamp means. Upon application of power, the thermistor has a high resistance, permitting the alternating voltage developed across the capacitor to break down the diac, triggering the triac and thereby operating the solenoid coil, which in turn causes said switching means to change its condition.

Shortly thereafter, as the thermistor is heated by current passing through it, its resistance falls to a value such that the breakdown voltage of the diac is not reached and the triac reverts to a high-impedance condition, causing the solenoid to drop out and remain unenergized. When power is removed, the thermistor cools and its resistance increases, ready for the next application of power.

In another preferred embodiment, the control circuit comprises a transistor in series with the electromechanical operating means and a dissipation-limiting resistor, the base of said transistor being connected through a parallel combination of a resistor and a capacitor, in series with a diode, to the live terminal of the first circuit. Additional protection and limiting components are included to prevent damage to the transistor due to transients generated in the circuit or externally.

When power is applied, the capacitor charges through the base of the transistor, which amplifies this current causing a much larger current to flow through its collector and through the solenoid, thereby operating the said switching means. When the capacitor has charged, the current is much reduced, allowing the solenoid to release. When power is subsequently removed, the capacitor discharges through its parallel resistor, ready for the next application of power. This circuit requires a smaller capacitor value than the first embodiment above because of the amplification provided by the transistor.

In an improved version of this embodiment, the transistor may be a Darlington-connected pair for higher amplification, permitting a smaller capacitor still, and the discharge rate of the capacitor may be increased by using a shorter discharge time constant. Instead of relying upon the time constant provided by the capacitor providing the base current of the transistor, a second delay circuit comprising a series combination of a resistor and a capacitor in parallel with a second and third resistor in series, the junction of which is connected to the base of a transistor, may be connected in parallel with the first circuit. The collector of the added transistor is connected to the base of the Darlington pair to turn it off when the added transistor starts to conduct.

This occurs after a time delay determined by the three resistors associated with the capacitor in said second delay circuit. A specific advantage conferred by this addition is that the Darlington pair is completely turned off, avoiding a possible thermal runaway condition due to the remaining small base current otherwise supplied by the resistor in parallel with said capacitor.

When power is removed, the second delay circuit capacitor also discharges, and the circuit is ready for a new application of power thereafter.

In another modification of this preferred embodiment, the second delay circuit is implemented by means of an opto-coupler comprising a light-emitting diode and a phototransistor in a common package, whose phototransistor is connected in place of the added transistor of the previous circuit to switch off the Darlington-connected transistor which actuates the solenoid. The light-emitting diode in the opto-coupler is illuminated after a delay which is determined by a series combination of a resistor and capacitor, the junction of which is connected to a transistor whose emitter is connected via a zener diode to the anode of the light-emitting diode in the opto-coupler and whose collector is connected via a current-limiting resistor to the positive supply rail of the circuit.

The preferred apparatus may further comprise a thermally-sensitive fuse or circuit breaker in series with the power line to the control means and operating means, and a combination of a small series resistor and a voltage-dependent resistor in parallel with the control and operating means, the former being provided to disconnect the control circuitry in the event of excessive temperatures being reached within the lamp enclosure which also contains the control means, and the latter being provided for the purpose of limiting any excessive voltage transients which may be present on the power supplied to the circuitry, to avoid damage being caused thereby. If the control circuitry employs a rectifier to provide a d.c. supply, a diode may be placed in parallel with the solenoid coil to minimize overshoot when the current is turned off.

A user-operable switch may be added in series with either power connection to said control means for the purpose of bringing the switching means operated thereby into the same state as those of other similar units connected to the power source through the same wall switch.

These and other and further objects and features of the invention are apparent in the disclosure and accompanying drawings. The preferred embodiments have varying degrees of complexity.

DETAILED DESCRIPTION OF THE DRAWINGS

Figure 1:
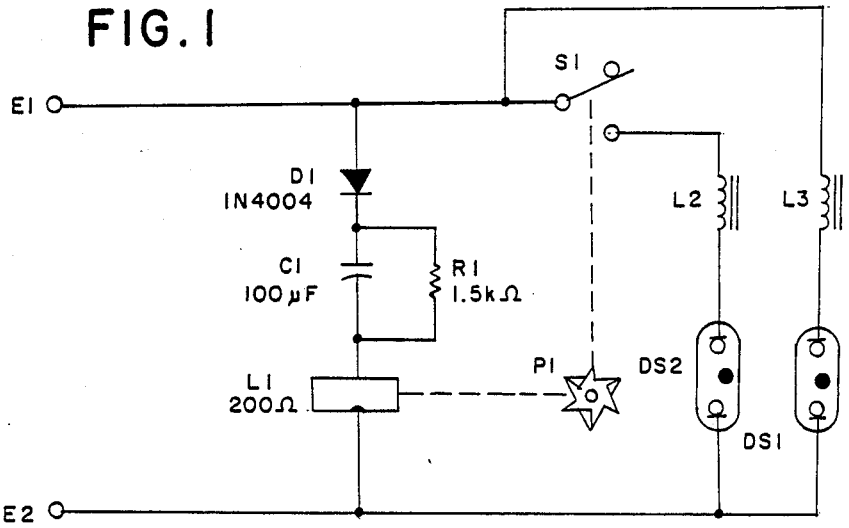
FIG. 1 is a simple electrical delay which is open-ended.

FIG. 1 shows a simple embodiment of the present invention that achieves the desired result. It comprises power terminals E1 and E2, a rectifier diode D1, a capacitor C1 and resistor R1 in parallel therewith, these components being in series with the solenoid coil L1. Solenoid L1 operates a pawl and integral cam P1 which operates switch S1. Ballast choke L3 and lamp DS1 in series are connected directly to power terminals E1 and E2, while ballast choke L2 and lamp DS2 in series are connected via switch S1 to power terminal E1 and directly to power terminal E2.

The circuit operation is as follows: when a.c. power is applied between terminals E1 and E2 from the wall switch, rectifier D1 passes current unidirectionally, which charges the capacitor C1 via the solenoid coil L1 to almost the peak a.c. voltage. The inrush current is sufficient, and lasts for long enough, that the solenoid L1 is operated fully, causing the pawl P1 to operate the switch S1, typically a microswitch. Once the capacitor is charged, the current through solenoid L1 falls to the average current flowing through resistor R1, which is much smaller than the initial charging current of C1, and the solenoid, which is spring-loaded, releases fully.

When power is switched off, the capacitor C1 discharges relatively slowly through the resistor R1, and after about three time-constants is ready for re-energization. The time constant must be short enough to permit rapid manual operation of the wall switch up to twice or three times per second. The discharge current must be small enough to cause only minimal heating and to permit full release of solenoid L1.

Power from the a.c. supply is applied via a main switch to terminals E1 and E2 and is always conducted through ballast choke L3 and a first lamp DS1 when the main switch is on. Each time the main switch is turned on, solenoid L1 is briefly energized, operating pawl P1 and changing the state of switch S1, which supplies power to ballast choke L2 and lamp DS2 on each alternate application of power to the circuit.

Experimentation with a typical solenoid-operated switch assembly which has a 200-ohm solenoid coil resistance has shown that a capacitor C1 of 100 to 200 microfarads is required to operate this solenoid. It should have a minimum rating of 200 V. The resistor R1 should have a value of about 1.5 kilohms to discharge this capacitor in 300 to 600 milliseconds. A capacitor of this value would typically be an electrolytic type, which has a relatively low maximum temperature rating, and the resistor value is such that a considerable power dissipation occurs.

Figure 2:
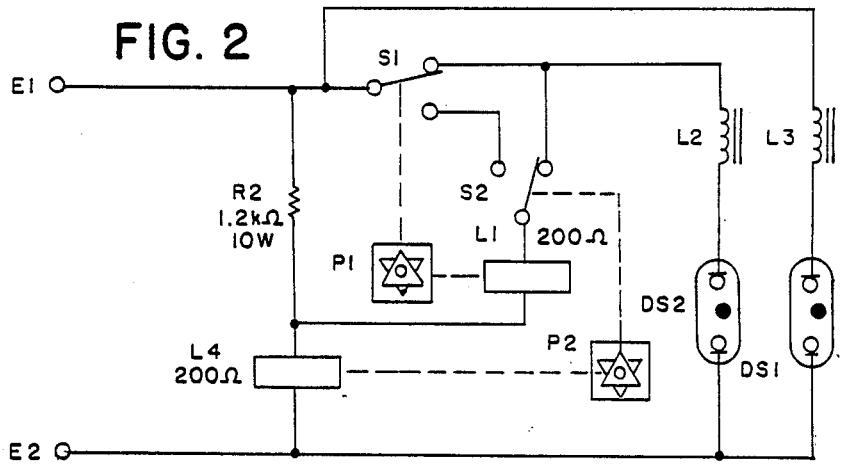
FIG. 2 is a simple closed loop electromechanical circuit in which pawl P1 operates switch S1 when solenoid L1 pulls in and pawl P2 operates switch S2 when solenoid L2 releases.

In FIG. 2, a second embodiment of closed loop type comprises a resistor R2, solenoid L1 operating switch S1 through combined pawl and cam P1, and a second solenoid L4 operating a second switch S2 through pawl and cam P2, in addition to the lamps DS1 and DS2 and their ballasts L3 and L2.

When power is applied to terminals E1 and E2, solenoids L1 and L4 are both energized via switches S1 and S2 and are pulled in. Pawl P1 operates S1, breaking the circuit through S1 and S2 to solenoid coil L1, which then drops out. The current flowing through R2 and L4 is sufficient to hold in L4. Pawl and cam P2 is designed to operate only when solenoid L4 releases.

When power is turned off, S2 is operated and a direct path is once again made through both switches to solenoid L1, ready for the next application of power. For this apparatus to work properly, the inertia of the mechanical components of solenoid L1 must be sufficient to complete the operation of pawl P1 while S1 is disconnecting its coil. The force exerted by the return spring of solenoid L2 must be sufficient to operate the pawl P2. The power dissipation through resistor R1 while holding L4 pulled in may also be a consideration.

Figure 3:
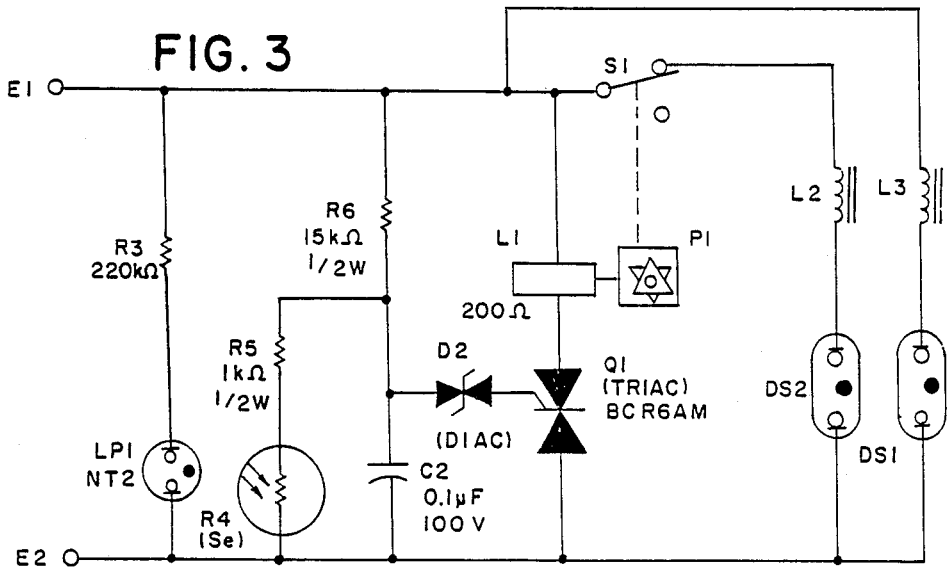
FIG. 3 is an open-ended circuit with an optoelectronic delay which depends on photocell response time.

In the circuit of FIG. 3, which uses an open-ended control means, the solenoid L1 is operated by a triac Q1 triggered repetitively while a.c. is present across capacitor C2 of sufficient voltage to reach the breakdown voltage of trigger diode or diac D2. This voltage is controlled by the resistance of a photoconductive cell R4 in series with resistor R5, which combination is in parallel with capacitor C2, and by the current delivered to C2 through resistor R6. The resistance of R4 is determined by the illumination provided by control lamp LP1, which may be a neon lamp, which is supplied with operating current through resistor R3.

When power is applied to the circuit terminals E1 and E2, during the first half-cycle after switching on, neon lamp LP1 strikes, illuminating the photoconductive cell R4, whose resistance begins to fall. During this period, the voltage across capacitor C2 is sufficient to break down diac D2 and to trigger triac Q1, thereby energizing the solenoid L1 and operating switch S1 via pawl and cam assembly P1.

When the resistance of photocell R4 falls, the phase of the voltage applied to triac Q1 rapidly changes, and the current supplied to solenoid L1 falls, until the solenoid releases. The illumination of LP1 during each half-cycle of the applied voltage ensures that the resistance of photocell R4 remains low as long as power is applied, and the voltage across capacitor C2 is insufficient to break down diac D2, so that triac Q1 remains non-conductive.

When power is removed, the resistance of photocell R4 rapidly increases, reaching its original dark resistance value in a few seconds. The time during which solenoid L1 is energized depends on the dark-to-light response time of the photoconductive cell, which is somewhat unpredictable and also uncontrollable, and may be too short for reliable operation of the solenoid-operated switch assembly. The continuous power dissipation through the resistors R6 and R3 may be higher than is desirable.

Figure 4:
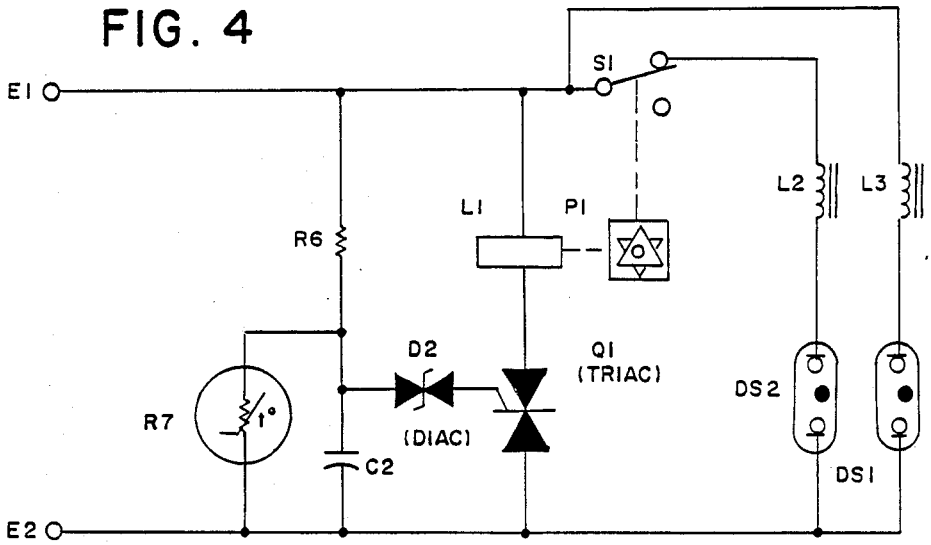
FIG. 4 shows a thermal delay circuit using a bead thermistor.

The circuit of FIG. 4 provides an example of a control means employing a thermal delay mechanism to determine the duration of the solenoid operation. As in the previous Figure, solenoid L1 is driven by triac Q1, which is triggered by means of the a.c. voltage developed across capacitor C2 by the current supplied through resistor R2. For the triac to operate, this voltage must be sufficient to break down diac D2 and trigger triac Q1. Initially, as in the previous circuit, there is sufficient voltage across C2 to cause Q1 to pull in solenoid L1, operating switch S1 and changing its state.

A negative temperature coefficient thermistor R7 is placed in parallel with capacitor C2, and sufficient voltage is present across this component initially to cause resistive heating of this component. As its temperature increases, its resistance falls until there is a balance between the power it dissipates and the power that resistor R6 can supply to it. At this point, the voltage across it is insufficient to break down diac D1 and triac Q1 is therefore non-conductive and solenoid L1 is released.

When power is removed, the thermistor cools down, and its resistance rises, permitting the triac to operate when power is again applied. For a reasonably fast response, the thermistor should be a low-mass bead type preferably in a glass envelope. The time that the solenoid is operated depends upon this response time, the value of R1, the breakdown voltage of diac D1, and the operating temperature of the circuit, among other things, and the design has the disadvantage of being thermally sensitive.

In place of the diac and triac, it would also be possible to use a transistor to drive the solenoid, and a zener diode with a suitable series resistor to provide its base current. The power supplied to the control circuit would also have to be rectified similarly to the following circuits.

Figure 5:
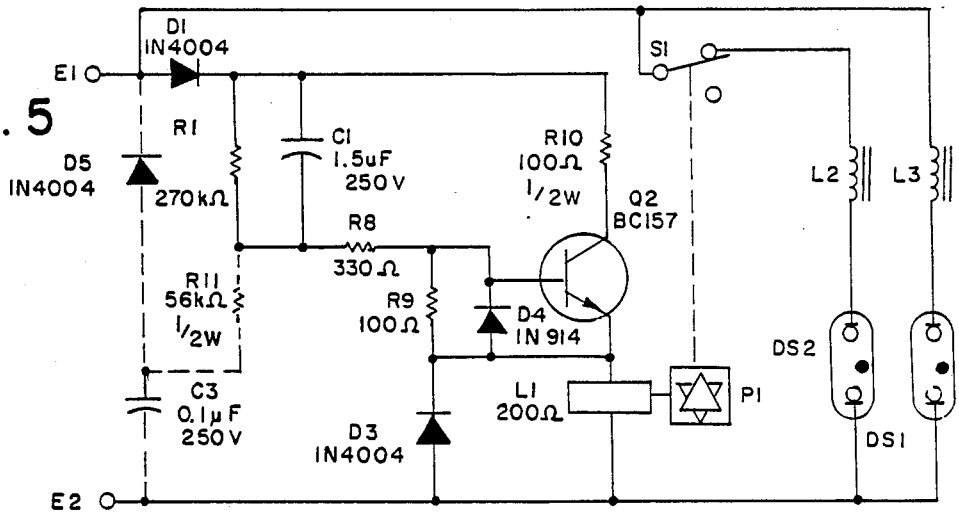
FIG. 5 shows an amplified capacitor type of electronic delay. Components shown dotted inprove thermal stability by applying reverse bias to Q1 after initial activation.

Variants of the simple electrical delay type of FIG. 1 are shown in the next three Figures. In FIG. 5, a high-voltage transistor Q2 drives the solenoid L1 in its emitter circuit, and its base current is supplied through capacitor C1. Because of the current amplification provided by Q2, this capacitor can be much smaller than that of FIG. 1. Resistor R1 which serves to discharge C1 must be larger by a corresponding factor. There are additional components in this circuit whose function will now be explained.

Resistor R8 serves to limit the peak base current of transistor Q2 to a safe value. Resistor R9 ensures that transistor Q2 is properly cut off when the charging current through C1 has diminished sufficiently. Resistor R10 limits the maximum dissipation in transistor Q2 while not significantly limiting the current that is supplied to solenoid L1. Diode D3 prevents overshoot of back e.m.f. when Q2 cuts off the current through L1. Diode D4 similarly prevents reverse biasing of the base-emitter junction of transistor Q2 and consequent damage.

To improve thermal stability, the components shown dotted in FIG. 5 may be added. Diode D5 and capacitor C3 set up a reverse voltage which is applied through resistor R11 to ensure that the base of transistor Q2 is completely cut off after the initial charging transient which operates L1 through Q2 has subsided. The basic circuit has a limitation that the ratio of the discharge resistor R1 to the base-to-emitter resistor R9 must be at least 100 to 1, or the solenoid will be partially energized after the initial transient. Reverse-biasing the transistor completely eliminates this effect, allowing the discharge time constant to be independent of the charging performance. In this case, the value of resistor R9 may be higher than shown.

Figure 6:
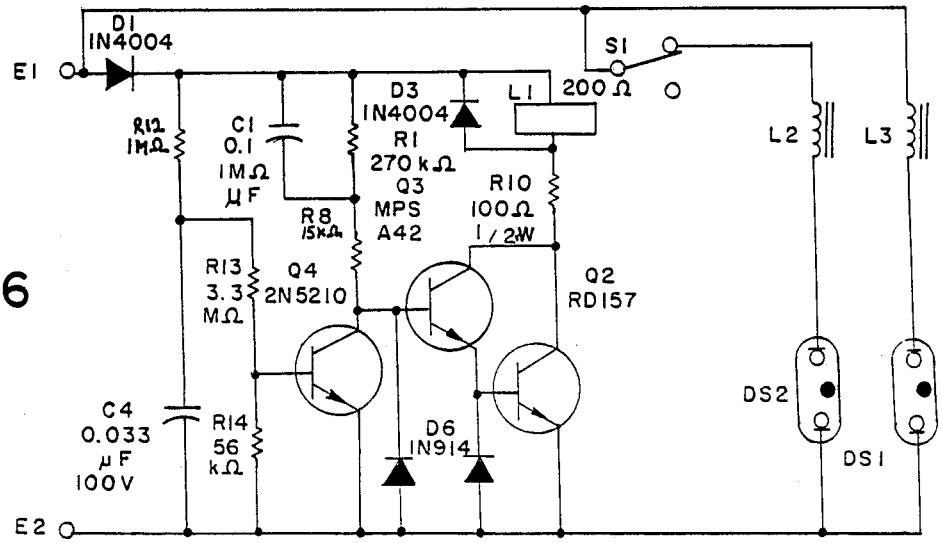
FIG. 6 is an improved electronic delay circuit. Turn-off delay is controlled by R1, C1, R2 and Q1, which holds Q2 and Q3 off after an initial pulse provided by amplifying the charging current through C2.

No components are used that are particularly thermally sensitive. The use of a Darlington-connected transistor in place of Q2 further increases the current gain and permits smaller values of capacitor and larger resistor values to be used. Several versions using an additional transistor were tested, and the most promising approach is shown in FIG. 6.

This circuit uses a Darlington pair comprising transistors Q3 and Q2 in common emitter mode to drive solenoid coil L1. Again, series resistor R10 is provided to limit dissipation in Q2, and diode D3 to prevent overshoot of the voltage across L1 when Q2 is turned off. Diode D4 prevents reverse-biasing of transistor Q2 and diode D6 prevents reverse-biasing of transistor Q3. C1 provides its charging current via resistor R8 to the base of transistor Q3. This current is amplified by Q3 and then by Q2, providing sufficient current to pull in solenoid L1. As before, R1 discharges C1 when power is removed.

The charging time through R8 is now sufficiently long that the time delay for which the solenoid is energized is provided by the additional circuitry comprising transistor Q4, with capacitor C4 and resistors R12, R13 and R14. Capacitor C4 charges through resistor R12, and supplies base curent to transistor Q4. After a short delay, during which the solenoid is energised, sufficient current flows in resistors R13 and R14 to bias transistor Q4 on, turning off Q3 and thus Q2 and interrupting the current in solenoid L1, which releases. The circuit remains in this state until power is switched off, when capacitor C1 discharges through resistor R1 and capacitor C4 discharges through R13 and R14.

Figure 7:
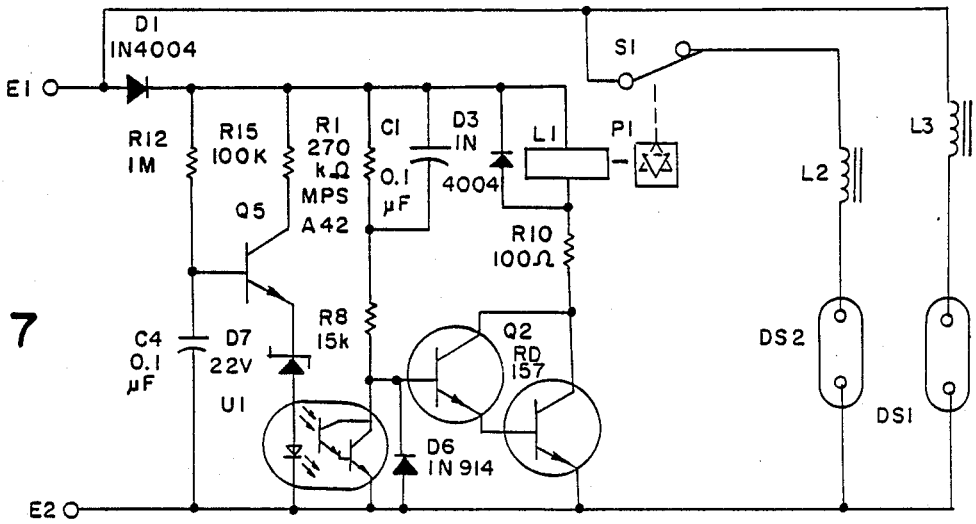
FIG. 7 shows an improved electronic delay circuit incorporating an optoelectronic delay in combination with an amplified charging current.

Another variation of this circuit is shown in FIG. 7. In this circuit, the components C1, C4, D1, D3, D6, DS1, DS2, E1, E2, L1, L2, L3, P1, Q2, Q3, R1, R8, R10, R12 and S1 have the same function as corresponding components in FIG. 6. Instead of transistor Q4, optoisolator U1, which comprises a phototransistor and a light-emitting diode in a common package, is used to turn off transistors Q3 and Q2. The delay is provided in this case by the time taken for capacitor C4 to charge to a voltage sufficient to turn on transistor Q5, passing current through zener diode D7 and the light-emitting diode inside U1. This current is limited by resistor R15. For improved sensitivity, the phototransistor inside U1 may be a Darlington pair, but this is not essential.

Figure 8:
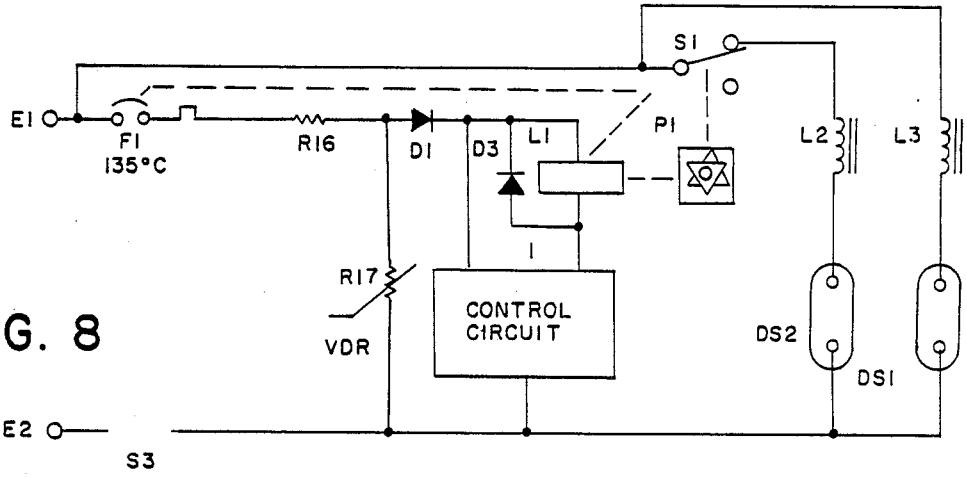
FIG. 8 shows the addition of circuit components for thermal and overvoltage protection requirements, and a user-operable switch for bringing the unit into step with other units.

FIG. 8 illustrates additional components which may be included with any of the preceding circuits for enhanced protection against excessive voltages or temperatures, and for user convenience features. The control means are shown in a representative block 1. Assuming that an electronic delay is being used, diodes D1 and D3 perform the functions previously explained.

To protect the electronic circuitry against excessive surge voltages which commonly occur on the a.c. power line, a varistor, or voltage dependent resistor R17 may be added in parallel with the control means. A small series resistor R16 enhances the effect of this varistor, or alternatively a small inductor may be used with similar effect. This combination typically prevents voltages in excess of 250 V in either polarity from being applied to the control circuit itself.

A thermal fuse may be preferentially located close to or in contact with the coil of solenoid L1, where it will sense an excessive temperature in this coil or in the enclosure. If this component should reach a temperature significantly above the rated maximum operating temperature of the circuit, it breaks the power connection, thereby disabling the circuit. The fuse is replaceable. Note that the power circuit through the switch to the lamps is not affected, so the lamps will continue to operate although no switching between levels will occur.

As a convenience feature a switch S3 may be added in series with either power line to the entire circuit, or just to the control circuit. This switch is normally closed, and when operated and released, it causes the solenoid-operated switch in this particular control unit to change state, in order to bring it into step with other similar units connected to the same wall switch. Thus several units on one lighting circuit may be controlled simultaneously by the wall switch.

Various additional forms of control circuit may be used instead of those shown. For example, an extension of the circuit shown in FIG. 2 could employ electronic means to determine when the solenoid has operated, and to switch off the solenoid power shortly after this has occurred.

Figure 9:
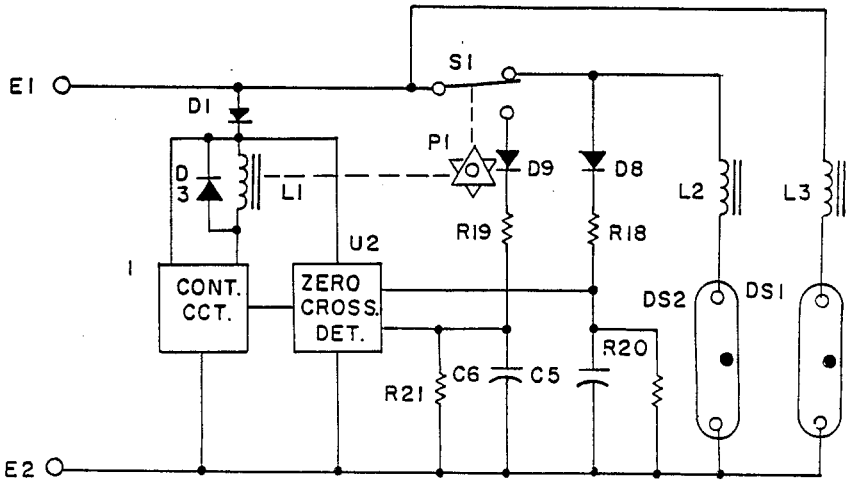
FIG. 9 shows a closed loop control means wherein a zero-crossing detector is employed to determine that the switching means has operated and to remove power from the operating means.

This is possible, as shown in FIG. 9, because the microswitch S1 usually has a free contact. The two contacts are each connected through a diode D8, D9 and a series resistor R18, R19 to a capacitor C5, C6 and parallel resistor R20, R21. Initially, capacitor C5 is fully charged, and when the switch S1 changes over, the second capacitor C6 begins to charge, while the first discharges through its parallel resistor R20. Some time shortly after the switch has operated, the difference between the voltages across the two capacitors passes through zero, and a zero crossing detector circuit U2 is used to detect this and to remove power from the solenoid through action upon control circuit 1.

The open loop type of circuit is reliable as long as the time constant is substantially longer than the maximum time required to fully operate the solenoid. In a closed loop circuit, however, failure of the solenoid to operate the microswitch, or failure of the microswitch itself, could prevent the circuit from turning off power to the solenoid and cause overheating. Accordingly, there should always be a fixed time delay beyond which the circuit will shut off the solenoid power.

Various combinations of these systems may be devised. For example, a control means may use an optoelectronic device in conjunction with an electronic delay, as in FIG. 7. A thermal delay may be used in conjunction with an optoelectronic circuit. In a thermal delay circuit, a bead thermistor may be directly or indirectly heated, or may be heated by the power dissipated in the solenoid coil (in this case there must be an additional method to ensure that power to the solenoid remains off after it has cooled until the next removal and reapplication of power to the whole circuit.) A bimetal strip may be electrically heated, as in a thermostat, to control a switch. A filament lamp used with a photoconductive cell has an additional thermal time constant due to the heating of the filament, as well as the response time of the photocell resistance.

In a optoelectronic-mechanical embodiment, a light beam may be interrupted by the pawl to determine completion of the solenoid action and detection of this event can terminate the solenoid current.

Numerous combinations of the above techniques may be suggested, but the circuit complexity may well be greater than that of the circuits shown herein.

With regard to the circuits shown, several factors must be taken into account to meet all the design goals. These include the voltage, current and power ratings of components at the temperatures likely to be encountered, physical size constraints and clearances between circuit pads sufficient for the voltages between them, effects of abnormal operation, effects of component failures, operation with externally applied voltage surges, spikes and reductions or interruptions, and EMI/RFI caused by the circuit operation.

For operation at 120 V a.c. the rectifier D1 and diode D3 should have adequate voltage ratings in the region of at least 350 to 400 V. Capacitors connected across the high voltages should be rated at 200 V or higher at elevated temperatures. Typical mylar capacitors of good quality are generally derated to 70% of nominal voltage ratings at 105 degrees C., while other types, such as electrolytics, are not generally usable above 85 degrees C. Transistors and thyristors or triacs should also have ratings of 200 to 250 V, except for low-voltage parts of the circuitry. Resistors should be adequately rated for operation at 105 degrees C., and leakage currents in semiconductor components should be low enough not to cause problems at these temperatures.

Most transistors and thyristors are rated for operation up to at least 150 degrees C. with adequate heatsinking and/or derating. Potting the electronic assembly in high thermal conductivity epoxy resin can help, since the circuit is normally operated intermittently and is quiescent, at a low power dissipation, the rest of the time after initial application of power.

The preferred embodiment circuit board layout must have adequate clearances between lands and traces at high voltages to avoid tracking between them. This requires careful layout as the unit is required to fit into a restricted space.

Considering power interruptions and brownouts, normally all units should switch to the alternate state in the event of a short or longer outage. In most implementations, there will be some combination of low voltage for a specific short time which will cause some units to change state but not all. These occurrences can be minimized by careful design, and the units can be brought back into step using the optional switch shown in FIG. 8.

The preferred embodiments should usually include a means for protection against excessive temperatures caused either by failure of the circuitry or of external components such as the lamps or ballasts. A thermal fuse, or a combination of an ordinary fuse and a narrow-range thermistor, may be used to achieve this protection.

The limiting resistor R10 also serves a protective purpose, as in the event of failure of the transistor driving the solenoid and constantly applied power to the circuit, the resistor will generally fail (at 30 W dissipation) much sooner than the solenoid coil. The electronic module can be replaced and is less expensive than the solenoid. If the capacitor in the FIG. 5 circuit fails short-circuit, the 330 ohm resistor R8 will also fail very quickly, and the circuit will be disabled. Thus in typical embodiments, the results of component failures can be limited to preventing circuit operation without introducing any safety hazards.

The use of transistors instead of triacs or SCRs will minimize the possibility of transients that could cause RFI, but RFI generated by fluorescent lamps is likely to be more than such components would generate.

Figure 10:
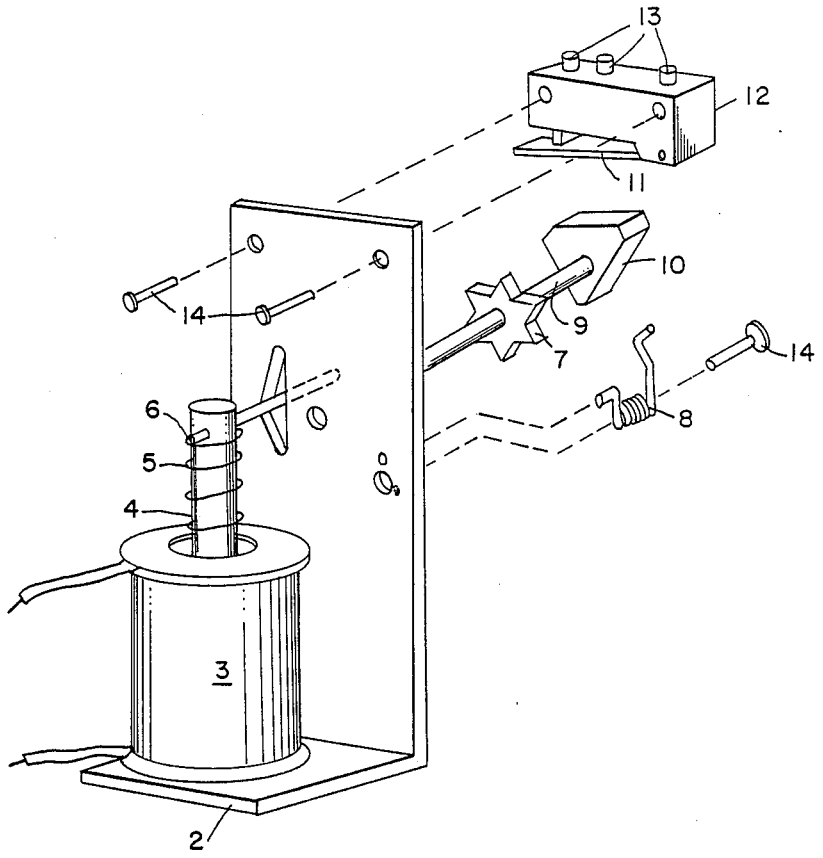
FIG. 10 shows a typical operating means comprising a solenoid operating a switch by means of a pawl driving a cam.

FIG. 10 shows a typical operating means which may be employed in conjunction with the control means desribed above. The solenoid 2 has a coil 3 and drives an armature 4 which is loaded with a spring 5. The armature carries a pin 6 which engages with a pawl 7 mechanically connected to a cam 10 on a common shaft 9. The pawl is held in a stable position by a spring 8. The cam operates a level 11 which is attached to a microswitch 12 having electrical contacts 13, and which is secured to the solenoid 2 by screws or rivets 14. When the solenoid coil 3 is energized, the armature 4 is pulled in against the spring 5 rotating the pawl 7 past the holding spring 8, which snaps into next the stable position. The cam 10 which may be of approximately triangular shape if the pawl has six teeth as shown, turns to a new position, operating the microswitch 12 through the action of lever 11.

When power is removed, the holding spring 8 prevents the pawl from turning in the reverse direction and the sloping tooth of the pawl diverts the pin on the solenoid armature as the spring 5 extends and pushes the armature to its original position.

On a subsequent operation, the pawl again turns the cam, this time releasing the switch lever and changing the switch to its original condition.

What is claimed is:

1. Apparatus for selectively illuminating first lamp means or first and second lamp means comprising a first circuit having terminals for connecting to a supply line from a wall switch and being connected to the first lamp means for turning the first lamp means on every time the wall switch supplies power to the terminals and the first circuit, a second circuit, the second lamp means connected to the second circuit, a first switching means connected between the second circuit and the first circuit for alternately connecting the second circuit with and disconnecting it from the first circuit, an operating means mechanically connected to the first switching means for changing the condition of the first switching means upon each operation of the operating means, control means electrically connected to the first circuit and to the operating means for moving the operating means upon each energization of the first circuit.

2. The apparatus of claim 1 wherein the operating means is an electromechanical operating means.

3. The apparatus of claim 2 wherein the electromechanical operating means comprises a cam for operating the first switching means, connected mechanically to a pawl and ratchet assembly comprising a pawl, a spring for holding the pawl in a stable position, and a ratchet means for driving the pawl from one stable position to the next, said ratchet means being mechanically connected to the armature of a solenoid whose operating coil is connected electrically to the control means.

4. The apparatus of claim 3 wherein the control means comprises a first diode connected in series with a first resistor and a first capacitor connected in parallel, these components being connected in series with an operating coil of the operating means, wherein power from the first circuit charges the capacitor through the diode and the coil of the operating means thereby moving the operating means and changing the condition of the switch, and wherein the resistor provides a discharge path for the capacitor when power is disconnected from the first circuit.

5. The apparatus of claim 3, wherein the first switch means comprises a first double-throw switch and the control means comprises a second double-throw switch, and further comprising a second operating means for changing the condition of a second switch means, and a second resistor connected in series with a second operating coil of said second operating means across the first circuit, the coil of the first operating means being connected in series with both first and second switch means in parallel with the second resistor, said second operating means being effective to change over the second switch means only when power previously applied to the second operating coil is removed, this control means being operative upon application of power to the first circuit to apply power through both first and second switch means to both first and second operating coils of said first and second operating means, causing said first operating means to change the condition of said first switch means, whereupon said first operating coil is disconnected from the power source, said second operating coil continuing to receive power through the second resistor, and upon removal of power from the first circuit, said second operating means causes said second switch means to change its condition thereby re-establishing a connection through both switch means to the first operating coil of said first operating means.

6. The apparatus of claim 3 wherein the control means comprises a triac connected in series with the operating coil of the first operating means across the first circuit, a diac having a first terminal connected to a control terminal of said triac, a first resistor connected in series with a first capacitor which is connected in parallel to a controllable resistor, these components being connected across the first circuit, and a second terminal of said diac being connected to the junction of the first resistor and the first capacitor, said controllable resistor having a high value initially and thereafter assuming a low value, said control means being operative to switch on said triac for a substantial part of each half-cycle of a.c. power whenever the controllable resistor has a high resistance and thereby to cause the first operating means to change the condition of the first switch means, and to prevent said triac from being switched on whenever the resistance of said controllable resistor falls to a low value.

7. The apparatus of claim 6 wherein said controllable resistor is a negative temperature coefficient thermistor, said transition from a high resistance to a low resistance being caused by heating of the thermistor during the period when power is applied to the first circuit, said thermistor being permitted to cool and return to a high resistance when power is removed from the first circuit.

8. The apparatus of claim 6 wherein said controllable resistor is a photoconductive cell and wherein said control means further comprises means to illuminate said photoconductive cell whenever power is applied to said first circuit, said photoconductive cell having a high resistance value when no illumination strikes it, and falling to a low resistance value shortly after it is illuminated by said illuminating means.

9. The apparatus of claim 8 wherein said illuminating means comprises a resistor connected in series with a neon lamp across said first circuit, said neon lamp being maintained proximate to said photoconductive cell.

10. The apparatus of claim 3 wherein the control means comprises a first diode and a first transistor connected in series with the operating coil of said operating means across the first circuit, the base terminal of the first transistor being connected to a first resistor in series with a first capacitor and a second resistor connected in parallel, and thence to the junction of the first diode with the series combination of the first transistor and said operating coil, said control means being operative when power is applied to said first circuit to charge the first capacitor through the first diode and the series first resistor and the base of the first transistor, the charging current of the first capacitor being amplified by the first transistor and used to energize the coil of said operating means and thereby to change the condition of the switch means, the second resistor in parallel with the first capacitor being effective to discharge the first capacitor when power is removed but not to provide sufficient current to the base of the first transistor while the power is applied to maintain the first transistor in a conductive condition after the first capacitor is fully charged and operation of the switch means has been completed.

11. The apparatus of claim 10 wherein said control means further comprises a third resistor connected in series with the first transistor and the operating coil of said operating means in order to limit the power dissipated in the first transistor to a safe value.

12. The apparatus of claim 10 wherein said control means further comprises a second diode connected in parallel with said operating coil of the operating means for the purpose of limiting the back electromotive force generated when the current in said coil is terminated to prevent an excessive voltage from being applied to said transistor.

13. The apparatus of claim 10 wherein said control means further comprises a second diode connected in reverse parallel with the base-to-emitter junction of said transistor in order to prevent a reverse voltage of sufficient magnitude to damage said transistor from being applied to said transistor junction.

14. The apparatus of claim 10 wherein said control means further comprises a third resistor connected in parallel with the base-to-emitter unction of the first transistor in order to bypass the small current flowing through the discharging second resistor in parallel with the first capacitor and thereby to ensure that the first transistor is non-conducting after the first capacitor has been fully charged.

15. The apparatus of claim 10 wherein said control means further comprises a second transistor connected in Darlington configuration with said first transistor, which is operative to increase the amplification of the charging current of the capacitor and thereby to permit a smaller value of capacitor to be used, together with larger values of the resistors in parallel and in series therewith.

16. The apparatus of claim 15 wherein said control means further comprises a second diode connected in reverse parallel with the base-to-emitter junction of said second transistor in order to protect said junction from damage caused by application of excessive reverse voltage thereto.

17. The apparatus of claim 15 wherein said control means further comprises additional means for actively turning off said first and second transistors shortly after the charging of the first capacitor has finished.

18. The apparatus of claim 17 wherein said additional means comprises a second diode in series with a second capacitor connected across the first circuit and a third resistor connected from the junction of said second diode and second capacitor to the base of the first transistor or of said second transistor if present, said circuit being operative to generate a reverse bias voltage across said second capacitor and to apply a suitable proportion thereof to the base of the first transistor to reverse bias its base to emitter junction after the charging current from the first capacitor has ceased.

19. The apparatus of claim 17 wherein said additional means comprises a third transistor connected between the base and emitter of the first transistor or of said second transistor if present, and further comprises a second capacitor in series with a third resistor, connected across the first circuit through the first diode, and a fourth resistor from the junction of these components to the base of said third transistor, and a fifth resistor connected from the base to the emitter of said third transistor, said second capacitor being charged through the series third resistor thereby causing said third transistor to be turned on after a short period which in turn switches off said first and second transistors.

20. The apparatus of claim 17 wherein said additional means comprises an optocoupler consisting of a phototransistor and a light-emitting diode in a common package. Said phototransistor being connected across the base-to-emitter junction of the transistor first or of the second transistor if present, and further comprises a circuit for turning on the light-emitting diode of said optocoupler after a short time.

21. The apparatus of claim 20 wherein said circuit for turning on the light-emitting diode comprises a second capacitor and third resistor in series connected across the first circuit through the first diode, and a second transistor whose base is connected to the junction of said second capacitor and third resistor, and whose emitter is connected in series with a zener diode to said light-emitting diode, and whose collector is connected in series with a fourth resistor to the first circuit through the first diode for the purpose of limiting the current applied to the light-emitting diode, and is operative to turn on the light-emitting diode after a delay which is the time taken for the second capacitor to charge to a voltage sufficient to break down said zener diode.

22. Apparatus according to claim 1 wherein said control means further comprises a voltage-dependent resistor connected in parallel therewith operative to protect said control means against excessive transient voltages which may be present on the power supplied to the first circuit.

23. Apparatus according to claim 1 wherein a thermal fuse is provided in series with said control means and is effective to break the circuit to said control means if the operating temperature of the operating means or in the vicinity of the control means is excessively high.

24. Apparatus according to claim 1 wherein a user-operable switch is provided in series with the connection to the control means for the purpose of bringing an individual unit of the specified apparatus into the same condition as other similar units which may be connected to the same wall switch.

* * * * *